US011739619B2

(12) United States Patent
Sheth et al.

(10) Patent No.: US 11,739,619 B2
(45) Date of Patent: Aug. 29, 2023

(54) OIL CIRCULATION IN AN ELECTRIC SUBMERSIBLE PUMP (ESP) ELECTRIC MOTOR

(71) Applicant: Halliburton Energy Services, Inc., Houston, TX (US)

(72) Inventors: Ketankumar Kantilal Sheth, Tulsa, OK (US); Donn J. Brown, Tulsa, OK (US); Dezhi Zheng, Tulsa, OK (US); Robert Charles De Long, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 20 days.

(21) Appl. No.: 17/530,714

(22) Filed: Nov. 19, 2021

(65) Prior Publication Data

US 2023/0160286 A1 May 25, 2023

(51) Int. Cl.

| | |
|---|---|
| ***E21B 43/12*** | (2006.01) |
| ***F04B 47/08*** | (2006.01) |
| ***E21B 47/06*** | (2012.01) |
| *F04D 13/10* | (2006.01) |

(52) U.S. Cl.

CPC ..... *E21B 43/128* (2013.01); *E21B 47/06* (2013.01); *F04B 47/08* (2013.01); *F04D 13/10* (2013.01)

(58) Field of Classification Search

CPC ..... E21B 43/128; E21B 43/126; E21B 47/06; E21B 43/13; E21B 43/129; F04B 47/06; F04B 47/00; F04D 13/10

See application file for complete search history.

(56) References Cited

U.S. PATENT DOCUMENTS

| | | | | |
|---|---|---|---|---|
| 6,837,621 | B1 | 1/2005 | Sakamoto | |
| 8,076,809 | B2 | 12/2011 | Tingler et al. | |
| 8,358,043 | B2 | 1/2013 | Tetzlaff et al. | |
| 2010/0244595 | A1 * | 9/2010 | Sheth | F04B 47/06 310/54 |
| 2016/0130923 | A1 * | 5/2016 | Nowitzki | F04D 29/086 166/66.4 |

(Continued)

OTHER PUBLICATIONS

Sheth, Ketan et al., "Viscosity Correction Factors," 2009 Society of Petroleum Engineers—Gulf Coast Section Electric Submersible Pump Workshop, Apr. 29-May 1, 2009, 11 pages, SPE—Gulf Coast.

(Continued)

*Primary Examiner* — Caroline N Butcher

(74) *Attorney, Agent, or Firm* — Conley Rose, P.C.; Rodney B. Carroll

(57) ABSTRACT

An electric submersible pump (ESP) electric motor. The ESP electric motor comprises a housing; a stator retained within the housing; a drive shaft; and an at least one rotor mechanically coupled to the drive shaft and located concentric with and inside of the stator, wherein an inside surface of the stator defines a groove extending from an upper end to a lower end of the stator, an outside surface of the at least one rotor defines a groove extending from an upper end to a lower end of the at least one rotor, an inside surface of the at least one rotor defines a groove extending from an upper end to a lower end of the at least one rotor, or an outside surface of the drive shaft defines a groove extending from below an male splines at an upper end to a lower end of the drive shaft.

20 Claims, 10 Drawing Sheets

(56) References Cited

U.S. PATENT DOCUMENTS

| | | | | |
|---|---|---|---|---|
| 2016/0222770 | A1 | 8/2016 | Kirk et al. | |
| 2019/0162457 | A1 | 5/2019 | De Larminat et al. | |
| 2020/0220431 | A1* | 7/2020 | Wrighton | H02K 7/083 |

OTHER PUBLICATIONS

Orrego, Yamila et al., "Enhanced ESP Motor Cooling-Design, Testing and Field Trial," 2011 Society of Petroleum Engineers—Gulf Coast Section Electric Submersible Pump Workshop, Apr. 25-29, 2011, 9 pages, SPE—Gulf Coast.

O'bryan, Roshani et al., "Validation of Heat Transfer Performance of Electrical Submersible Motor Using CFD," ASME 2010 3rd Joint US-European Fluids Engineering Summer Meeting and 8th International Conference on Nanochannels, Microchannels, and Minichannels, Aug. 2-4, 2010, 9 pages, American Society of Mechanical Engineers.

Jankowski, Todd A. et al., "Development and Validation of a Thermal Model for Electric Induction Motors," IEEE Transactions on Industrial Electronics, Dec. 2010, vol. 57, No. 12, pp. 4043-4054, IEEE.

Foreign Communication from Related Application—International Search Report and Written Opinion of the International Searching Authority, International Application No. PCT/US2022/045539, dated Feb. 1, 2023, 11 pages.

* cited by examiner

OIL CIRCULATION IN AN ELECTRIC SUBMERSIBLE PUMP (ESP) ELECTRIC MOTOR

STATEMENT REGARDING FEDERALLY SPONSORED RESEARCH OR DEVELOPMENT

Not applicable.

CROSS-REFERENCE TO RELATED APPLICATIONS

None.

REFERENCE TO A MICROFICHE APPENDIX

Not applicable.

BACKGROUND

Electric submersible pump (ESP) assemblies may comprise an electric motor, a seal section coupled to the electric motor, a fluid inlet coupled to the seal section, and a centrifugal pump coupled to the fluid inlet. A drive shaft of the electric motor is coupled to a drive shaft of the seal section, and the drive shaft of the seal section passes through the fluid inlet and couples to a drive shaft of the centrifugal pump assembly. When the electric motor is supplied electric power from the surface, the electric motor turns the drive shaft of the electric motor. The drive shaft of the electric motor then turns the drive shaft of the seal section, and the drive shaft of the seal section turns the drive shaft of the centrifugal pump assembly. The centrifugal pump assembly may comprise one or more pump stages, where each pump stage comprises an impeller coupled to the drive shaft of the centrifugal pump assembly and a diffuser that is coupled to an outer housing of the centrifugal pump assembly. The electric motor turns, the impellers turn, reservoir fluid is draw into the fluid inlet and lifted by the one or more pump stages to the surface. Electric motors of ESP assemblies are typically turned at rates between 3450 RPM and 3650 RPM and are operated continuously. It is desirable that the ESP assemblies operate for upwards of a year continuously without maintenance to achieve production goals and manage maintenance costs. Some ESP assemblies may incorporate a gas separator assembly located between the fluid inlet and the centrifugal pump whose purpose is to separate a gas phase fluid fraction (or higher gas liquid ratio fraction) of the reservoir from a liquid phase fluid fraction (or a lower gas liquid ratio fraction) of the reservoir fluid, exhaust the gas phase fluid into an annulus formed between the inside of wellbore and the outside of the ESP assembly, and flow the liquid phase fluid to the inlet of the centrifugal pump.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
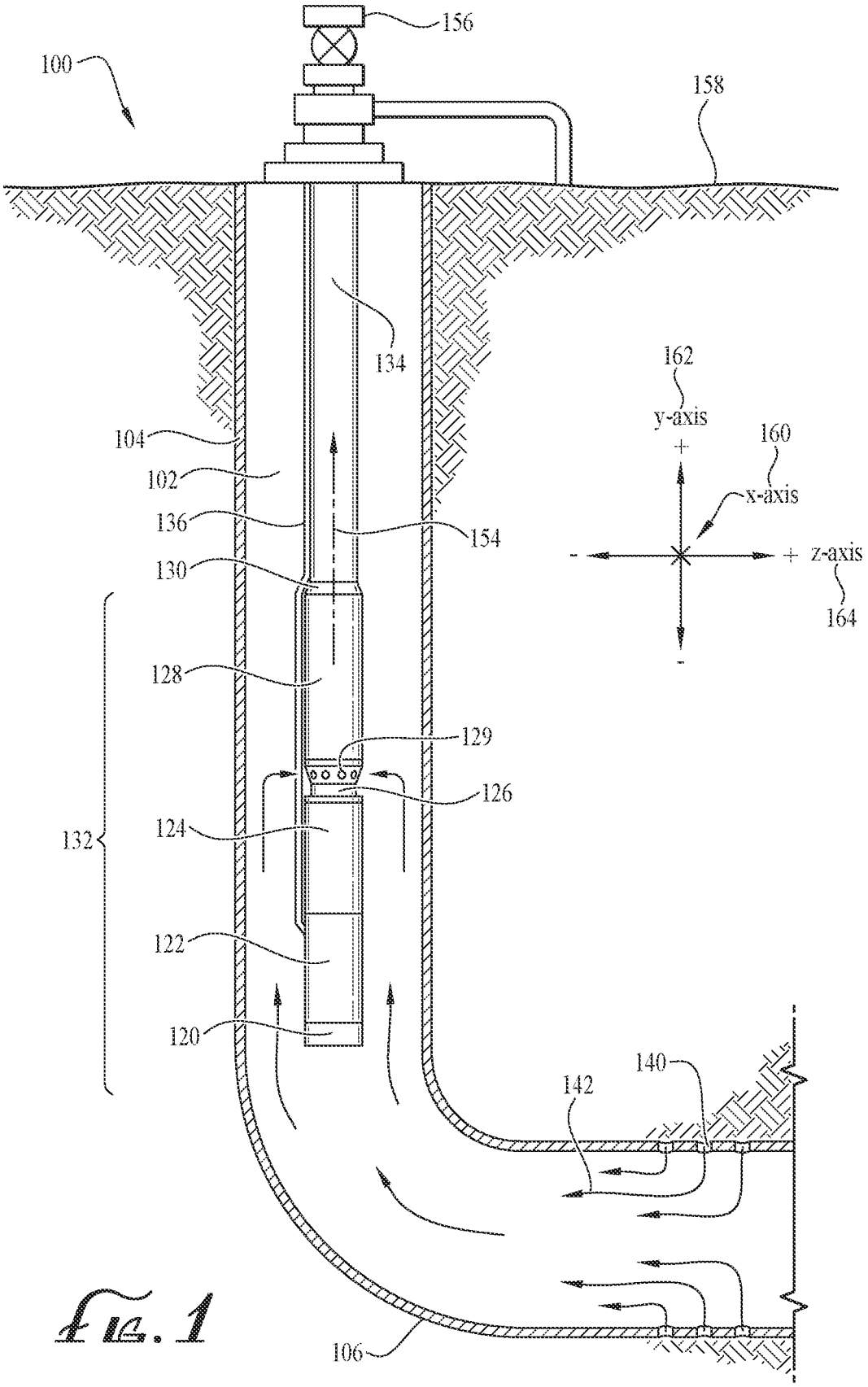
FIG. 1 is an illustration of a wellsite and an electric submersible pump (ESP) assembly in a wellbore at the wellsite according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," "down," "uphole," and "downhole" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" is directed counter to the direction of flow of well fluid, towards the source of well fluid. "Up" is directed in the direction of flow of well fluid, away from the source of well fluid. "Downhole" is directed counter to the direction of flow of well fluid, towards the source of well fluid (towards a bottom of the wellbore). "Uphole" is directed in the direction of the flow of well fluid, towards a surface (towards a top of the wellbore).

ESP assemblies operate in a challenging environment. Wellbores in some environments are tight. For example, the trend is towards drilling narrower diameter wellbores, whereby to reduce drilling costs. Tighter wellbores impose technical obstacles, including transferring heat generated by the electric motor away from the motor. Heat generated by a variety of processes in the electric motor is transferred away from the heat source by a housing of the electric motor, for example to wellbore fluid surrounding the ESP assembly. Heat may be produced in the electric motor by current flow in electric motor windings and by core losses in the electric motor stator core and rotor core. Core loses can include eddy current losses and hysteresis losses. Heat may be produced in the electric motor by bearing/bushing friction, and other processes. The electric motor is located below the fluid inlet of the ESP assembly, hence wellbore fluid may flow upwards over the outside surface of the housing of the electric motor, receiving heat transferred from the housing. But heat may concentrate in an upper end of the electric motor, creating a "hot spot." Often electrical failures occur in the upper ends of electric motors, probably due to excess heat in the upper ends of the electric motors. Heat also tends to concentrate in electric motors near the longitudinal axis of the electric motor and to flow radially outwards. Heat transfer occurs from a region of higher temperature to a region of relatively lower temperature.

The present disclosure teaches new structures for moving oil within the electric motor, whereby to improve the cooling of the electric motor and/or to promote even distribution of heat within the electric motor to avoid hot spots. In an embodiment, one or more grooves may be defined in an inside surface of an electric motor stator, in an outside surface of an electric motor rotor, in an inside surface of an electric motor rotor, and/or on an outside surface of a drive shaft of the electric motor. The one or more grooves can provide enhanced flow paths for oil within the electric motor, and the enhanced flow of oil can assist in transferring heat out of the electric motor. In an embodiment, the grooves may be parallel to the longitudinal axis of the electric motor. In an embodiment, the grooves may be defined in a helical form.

Turning now to FIG. 1, a wellsite 100 is described. The wellsite 100 comprises a wellbore 102 optionally lined with a casing 104, an electric submersible pump (ESP) assembly 132 in the wellbore 102, and a production tubing string 134. The ESP assembly 132 comprises an optional sensor unit 120 at a downhole end, an electric motor 122 coupled to the sensor unit 120 uphole of the sensor unit 120, a seal section 124 coupled to the electric motor 122 uphole of the electric motor 122, a fluid intake 126 coupled to the seal section 124 uphole of the seal section 124, a production pump assembly 128 coupled to the fluid intake 126 uphole of the fluid intake 126, and a pump discharge 130 coupled to the production pump assembly 128 uphole of the production pump assembly 128. The pump discharge 130 is coupled to the production tubing string 134. In an embodiment, a motor head or pot head (not shown) is coupled between the electric motor 122 and the seal section 124.

In an embodiment, the casing 104 has perforations 140 that allow reservoir fluid 142 to enter the wellbore 102 and flow downstream to the fluid intake 126. The reservoir fluid 142 enters inlet ports 129 of the fluid intake 126, flows from the fluid intake 126 into an inlet of the production pump assembly 128, is pumped by the production pump assembly 128 to flow out of the production pump assembly 128 into the pump discharge 130 up the production tubing string 134 to a wellhead 156 located at the surface 134. In an embodiment, an electric cable 136 is connected to the electric motor 122 and provides electric power from an electric power source located at the surface 158 to the electric motor 122 to cause the electric motor 122 to turn and deliver rotational power to the production pump assembly 128. In an embodiment, the electric cable 136 attaches to the electric motor 122 via a motor head or pot head. In an embodiment, the production pump assembly 128 comprises one or more centrifugal pump stages, where each centrifugal pump stage comprises an impeller coupled to a drive shaft of the production pump assembly 128 and a diffuser retained by a housing of the production pump assembly 128. The drive shaft of the production assembly is coupled to a drive shaft of the seal section 124. The drive shaft of the seal section 124 is coupled to a drive shaft of the electric motor 122. In some contexts, the production pump assembly 128 may be referred to as a centrifugal pump assembly. The production pump assembly 128 may be said to lift the reservoir fluid 154 to the surface 158.

In an embodiment, the ESP assembly 132 may further comprise a gas separator assembly, for example located between the fluid intake 126 and the production pump assembly 128. The gas separator assembly may induce rotational motion of the reservoir fluid 142 within a separation chamber such that high gas liquid ratio fluid concentrates near a drive shaft of the gas separator assembly and a low gas liquid ratio fluid concentrates near an inside housing of the gas separator assembly. The high gas liquid ratio fluid exits the gas separator by gas discharge ports to an exterior of the gas separator (e.g., into the wellbore 102 outside the ESP assembly 132), and the low gas liquid ratio fluid is flowed by liquid discharge ports to the inlet of the production pump assembly 128. In this way, the gas separator assembly may provide a lower gas liquid ratio fluid to the production pump assembly 128 when the reservoir fluid 142 comprises a mix of gas phase and liquid phase fluid. In an embodiment, the gas separator assembly may comprise one or more fluid reservoirs that define empty annular spaces that may serve as fluid reservoirs that can continue to supply at least some liquid phase fluid during an extended gas slug impinging on the fluid intake 126. The drive shaft of the gas separator assembly may be coupled to the drive shaft of the seal section 124 at a downhole end and coupled at an uphole end to the downhole end of the drive shaft of the production pump assembly 128.

In an embodiment, the ESP assembly 132 may further comprise a charge pump assembly, for example located between the fluid intake 126 and the gas separator assembly. The charge pump assembly may comprise one or more fluid movers to urge the reservoir fluid 142 upwards to the gas separator assembly. The fluid movers of the charge pump assembly may be an auger coupled to a drive shaft of the charge pump assembly. The fluid movers of the charge pump assembly may be one or more centrifugal pump stages, where each centrifugal pump stage comprises an impeller coupled to a drive shaft of the charge pump assembly and a diffuser retained by a housing of the charge pump assembly. In an embodiment, the charge pump assembly may comprise one or more fluid reservoirs that define empty annular spaces that may serve as fluid reservoirs that can continue to supply at least some liquid phase fluid to the gas separator assembly during an extended gas slug impinging on the fluid intake 126. The drive shaft of the charge pump assembly may be coupled at a downhole end to the drive shaft of the seal section 124 and coupled at an uphole end to the downhole end of the drive shaft of the gas separator assembly.

An orientation of the wellbore 102 and the ESP assembly 132 is illustrated in FIG. 1 by an x-axis 160, a y-axis 162, and a z-axis 164. While the wellbore 102 is illustrated in FIG. 1 as having a deviated portion or a substantially horizontal portion 106, the ESP assembly 132 may be used in a substantially vertical wellbore 102. While the wellsite 100 is illustrated as being on-shore, the ESP assembly 132 may be used in an off-shore location as well.

Figure 2:
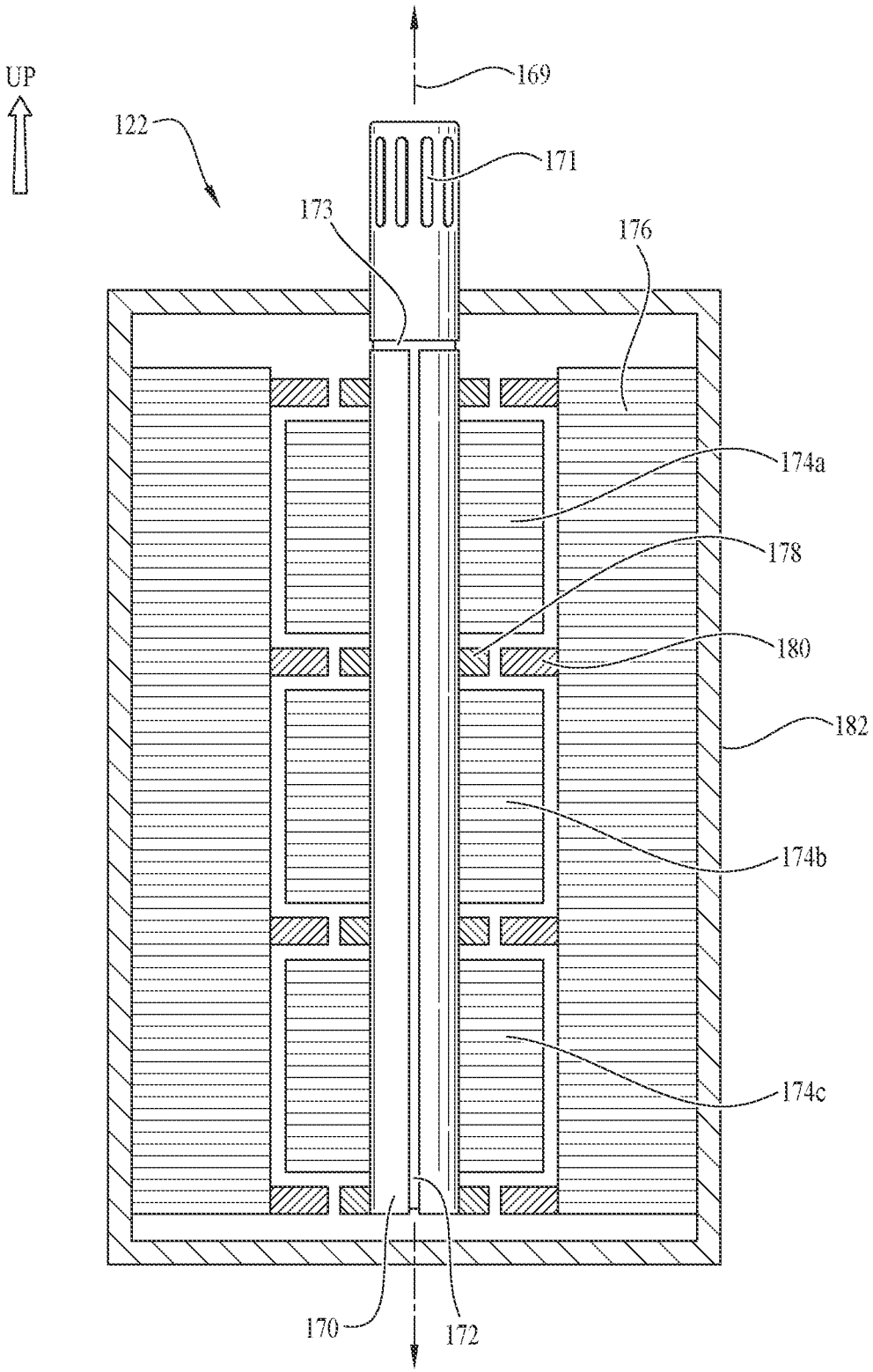
FIG. 2 is an illustration of an electric motor according to an embodiment of the disclosure.

Turning now to FIG. 2, further details of the electric motor 122 are described. It is understood that not all of the details of the electric motor 122 are depicted in FIG. 2. The electric motor 122 comprises a drive shaft 170 having male splines 171 at an upper end by which it may be coupled to a lower end of a drive shaft of the seal section 124. For example, a coupler featuring female splines disposed in an inner opening may mate with the male splines 171 of the drive shaft 170 and with male splines in a lower end of the drive shaft of the seal section 124. In an embodiment, the drive shaft 170 has a bore 172 that is concentric with a longitudinal axis 169 of the drive shaft 170 and that intersects at an upper end with a transverse through bore 173. In an embodiment, the electric motor 122 comprises a first rotor 174*a*, a second rotor 174*b*, a third rotor 174*c*, and a stator 176. While FIG. 2 depicts an electric motor 122 having three rotors 174, in another embodiment, the electric motor 122 may have a single rotor, two rotors, or more than three rotors. The rotors 174*a*, 174*b*, 174*c* are coupled to the drive shaft 170, for example by keyways in the rotors 174*a*, 174*b*, 174*c* and in the drive shaft 170 and a key (not shown) inserted into the keyways. The stator 176 is retained within a housing 182. The electric motor 122 may be a 3-phase alternating current (AC) motor, for example a squirrel cage type induction motor. Alternatively, the electric motor 122 may be a 3-phase AC permanent magnet motor.

The rotors 174*a*, 174*b*, 174*c* and the stator 176 may be formed of a number of plates, referred to as laminations, in the form of disks with a hole in the center and a plurality of apertures between an inside diameter and an outside diameter of the disk to establish channels to accommodate electrical conductors in the assembled rotors 174*a*, 174*b*, 174*c* and the assembled stator 176. These channels to accommodate electrical conductors are illustrated in later figures. Such laminations are employed to reduce eddy current losses in electric motor cores. These plates may be made of electrical steel. Electrical steel may be an iron alloy tailored to produce specific magnetic properties which result in low core losses and high permeability. In an embodiment, the surface of these plates may be chemically oxidized or treated with lacquer to reduce eddy current flows between plates. Alternatively, the plates may be made of other metal. The laminations may be formed by punching out the forms from sheets of metal, the traditional and conventional method of manufacturing laminations. The laminations may be formed by a process of 3-D printing, a relatively recently developed alternative method of manufacturing articles such as laminations.

In an embodiment, electrical conductors pass through channels formed in the stator 178 and are connected via the electric cable 136 to an electrical power source (not shown) at the surface 158. The conductors in the stator 178 may be wires or copper bars. In an embodiment, electrical conductors pass through channels formed in the rotors 176*a*, 176*b*, 176*c* and are shorted at their upper ends and at the lower ends by end rings. In an embodiment (e.g., when the electric motor 122 is a squirrel cage type induction motor), the end rings may be formed of brass. In another embodiment (e.g., when the electric motor 122 is a permanent magnet motor), instead of conductors the channels formed in the rotors 176*a*, 176*b*, 176*c* retain permanent magnets. None of the conductors, copper bars, end caps, or permanent magnets are shown in FIG. 2.

The electric motor 122 comprises a plurality of bearings 178 coupled to the drive shaft 170 and associated bushings 180 coupled to the stator 176. Each bearing 178 is located within a corresponding bushing 178, and together the pairs of bearings 176 and bushings 178 support the drive shaft 170 and maintain it in proper axial alignment. In an embodiment, the bushings 178 define oil passageways providing flow communication from an upper side of the bushings 178 to a lower side of the bushings 178 and in the opposite sense as well. Oil within the electric motor 122 may flow upwards through the bore 172, into the through bore 173, and out the through bore 173, through the oil passageways defined by the bushings 178, into and through a gap between the stator 176 and the rotors 174*a*, 174*b*, 174*c*, and complete an oil flow circuit by flowing back into the lower opening of the bore 172. In an embodiment the oil within the electric motor 122 may flow in the opposite direction described above. In an embodiment, a fluid mover coupled to the drive shaft 170 or installed within the bore 172 may urge the flow of oil in a circuit within the electric motor 122. In an embodiment, the oil in the electric motor 122 may be a dielectric oil.

Figure 3A:
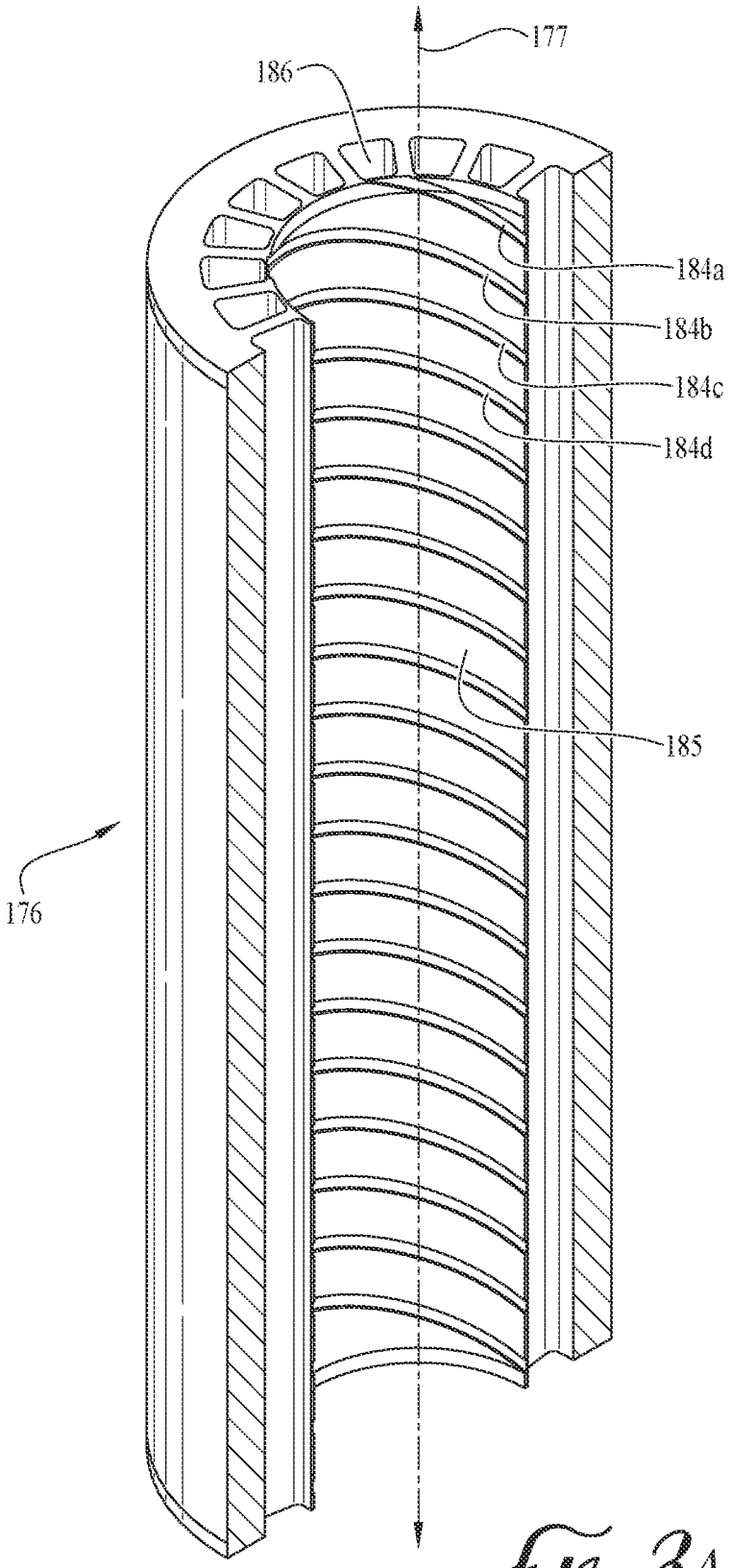
FIG. 3A is an illustration of a stator of an electric motor according to an embodiment of the disclosure.

Turning now to FIG. 3A, further details of the stator 176 are described. The stator 176 has a longitudinal axis 177 that is concentric with the longitudinal axis 169 of the drive shaft 170. In an embodiment, an inside surface 185 of the stator 176 defines a plurality of helical grooves: a first groove 184*a*, a second groove 184*b*, a third groove 184*c*, and a fourth groove 184*d*. The stator 176 further defines a plurality of channels 186 for electrical conductors. To simplify the illustration in FIG. 3A to better show the grooves 184, only one lamination is shown at an upper end of the stator 176 and only one lamination is shown at the lower end of the stator 176, but it is understood that the stator 176 is composed of many laminations as illustrated in FIG. 2. The grooves 184 provide channels to improve the flow of oil within the electric motor 122, whereby to enhance the transfer of heat out of the electric motor 122. While four grooves 184*a*, 184*b*, 184*c*, 184*d* are illustrated in FIG. 3A, it is understood that the inside surface 185 of the stator 176 may define two grooves, three grooves, or more than four grooves. The case of the inside surface 185 of the stator 176 defining a single groove 184 is illustrated and described with reference to FIG. 3B below.

The grooves 184 may be cut in the stator 176 after laminations are assembled to form the stator 176. Alternatively, the individual laminations may be cut with a groove slightly offset, and the helical groove established by aligning the individual laminations when assembling the stator 176. Alternatively, the individual laminations may be 3-D printed with a groove slightly offset, and the helical groove established by aligning the individual laminations when assembling the stator 176. In an embodiment, the grooves 184 may be cut in the stator 176 by machining the grooves 184 or by laser cutting the grooves 184 or by another method.

In an embodiment, the grooves 184 may be from 1/10000 (0.0001) inch deep to 1/100 (0.01) inch deep. In an embodiment, the grooves 184 may be from 1/10000 (0.0001) inch deep to 1/16 (0.625) inch deep. In an embodiment, the grooves 184 are about 2/10000 (0.0002) inch deep. In an embodiment, the grooves 184 are about 0.00025 inch deep to about 0.0005 inch deep. In an embodiment, the grooves 184 may be from about 1/10 (0.1) inch wide to about 1/2 (0.5) inch wide. In an embodiment, the groves 184 may be from about 1/16 (0.0625) inch wide to about 3/16 (0.1875) inch wide. In another embodiment, however, the grooves 184 may have a different depth and/or a different width. The depth of the grooves 184 may be limited by the separation between the inside diameter of the stator 176 and the channels 186. In an embodiment, the grooves 184 may have a cross-sectional shape that is rectangular, square, half-round, semi-circular, oblong, V-shaped, or other shape. The grooves 184 may have any rate of twist or pitch. The grooves 184 may have a 1 turn in 4 inches rate of twist, a 1 turn in 8 inches rate of twist, a 1 turn in 12 inches rate of twist, a 1 turn in 16 inches rate of twist, a 1 turn in 20 inches rate of twist, a 1 turn in 24 inches rate of twist, a 1 turn in 28 inches rate of twist, a 1 turn in 32 inches rate of twist, a 1 turn in 36 inches rate of twist, a 1 turn in 40 inches rate of twist, a 1 turn in 44 inches rate of twist, a 1 turn in 48 inches rate of twist, or some other rate of twist. In an embodiment, the grooves 184 may have a rate of twist between a 1 turn in 4 inches rate of twist and a 1 turn in 48 inches rate of twist. In an embodiment, the grooves 184 may have a rate of twist between 1 turn in 4 inches rate of twist and a 1 turn in 24 inches rate of twist. In an embodiment, the grooves are not twisted (not helical in form) and extend axially along the inside surface 185 of the stator 176 and parallel to the longitudinal axis 177 of the stator 176. While the grooves 184 are illustrated in FIG. 3A as turning in a first sense, in another embodiment, the grooves 184 may turn in an opposite sense.

Figure 3B:
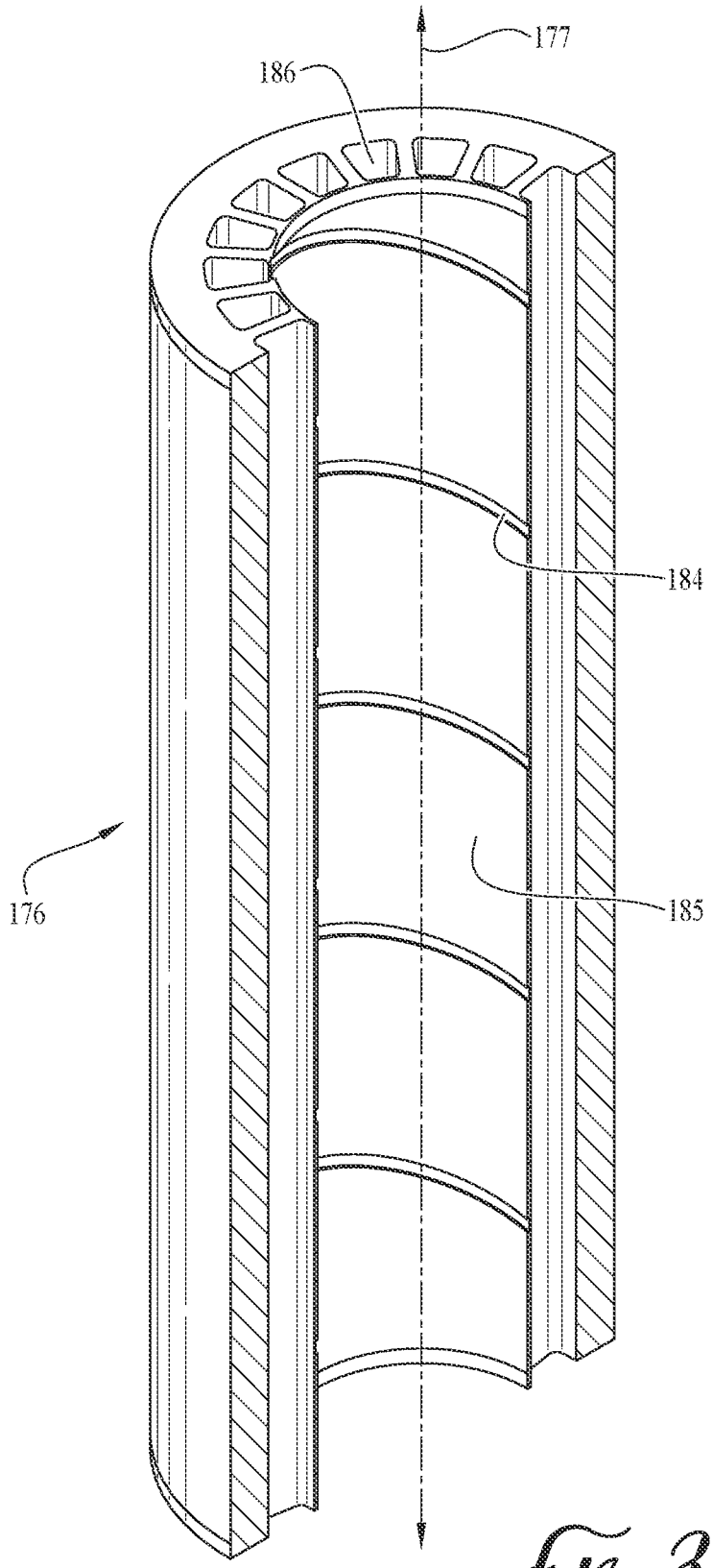
FIG. 3B is an illustration of another stator of an electric motor according to an embodiment of the disclosure.

Turning now to FIG. 3B, another embodiment of the stator 176 is described. In FIG. 3B, only a single groove 184 is defined by the inside surface 185 of the stator 176. The descriptions of the stator 176 above with reference to FIG. 3A apply to FIG. 3B, with the restriction that there is the single groove 184, and that the rate of twist of the groove 184 may have a higher rate of twist, for example a 1 turn in 1 inch rate of twist to a 1 turn in 12 inches rate of twist.

Figure 4A:
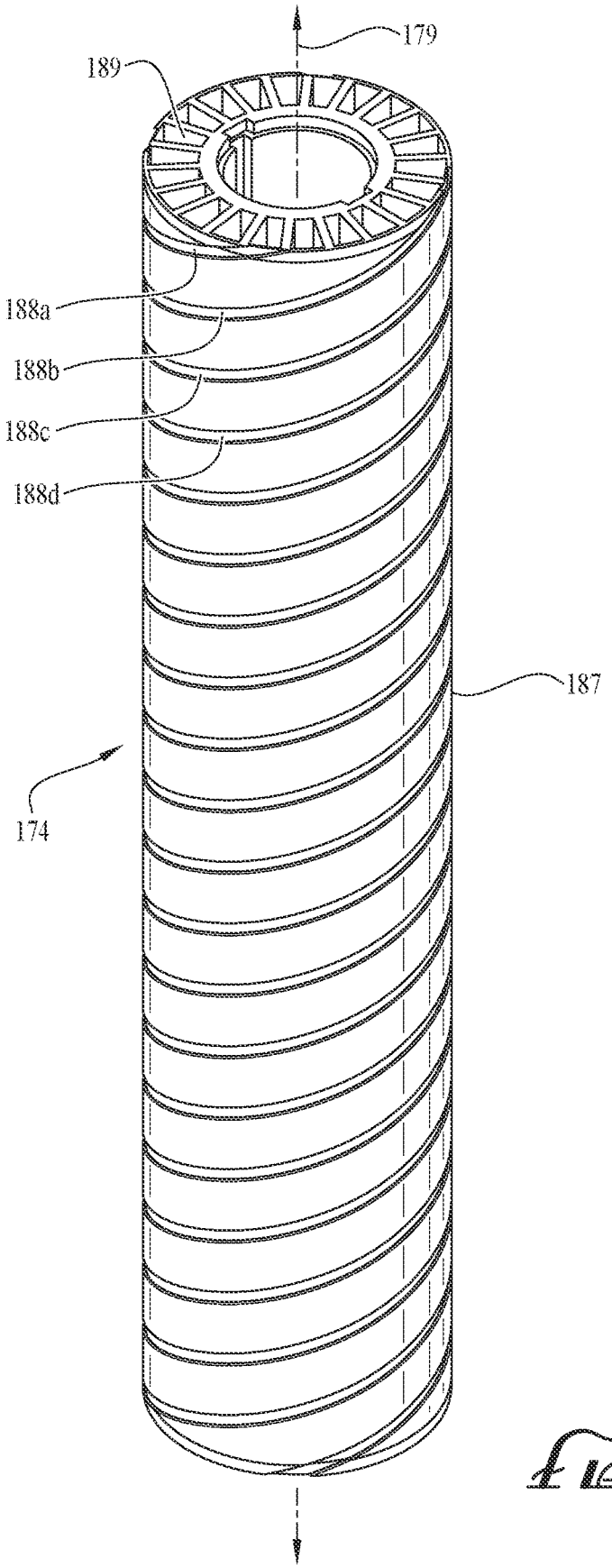
FIG. 4A is an illustration of a rotor of an electric motor according to an embodiment of the disclosure.

Turning now to FIG. 4A, further details of the rotor 174 are described. The rotor 174 has a longitudinal axis 179 that is concentric with the longitudinal axis 177 of the stator 176 and with the longitudinal axis 169 of the drive shaft 170. In an embodiment, an outside surface 187 of the rotor 174 defines a plurality of helical grooves: a fifth groove 188*a*, a sixth groove 188*b*, a seventh groove 188*c*, and an eighth groove 188*d*. The rotor 174 further defines a plurality of channels 189 for electrical conductors or for permanent magnets, depending on the type of the electric motor 122. To simplify the illustration in FIG. 4A to better show the grooves 188, only one lamination is shown at an upper end of the rotor 174 and only one lamination is shown at the lower end of the rotor 174, but it is understood that the rotor 174 is composed of many laminations as illustrated in FIG. 2. The grooves 188 provide channels to improve the flow of oil within the electric motor 122, whereby to enhance the transfer of heat out of the electric motor 122. While four grooves 188*a*, 188*b*, 188*c*, 188*d* are illustrated in FIG. 4A, it is understood that the outside surface 187 of the rotor 174 may define two grooves, three grooves, or more than four grooves. The case of the outside surface 187 of the rotor 174 defining a single groove 188 is illustrated and described with reference to FIG. 4B below.

The grooves 188 may be cut in the rotor 174 after laminations are assembled to form the rotor 174. Alternatively, the individual laminations may be cut with a groove slightly offset, and the helical groove established by aligning the individual laminations when assembling the rotor 174. Alternatively, the individual laminations may be 3-D printed with a grove slightly offset, and the helical groove established by aligning the individual laminations when assembling the rotor 174. The grooves 188 may be cut in the rotor 174 by machining the grooves 188 or by laser cutting the grooves 188 or by another method.

In an embodiment, the grooves 188 may be from 1/10000 (one ten thousandths) inch deep to 1/100 (0.01) inch deep. In an embodiment, the grooves 188 are about 2/10000 (0.0002) inch deep. In an embodiment, the grooves 188 may be from about 1/10 (0.1) inch wide to about ½ % inch wide. In an embodiment, the grooves 188 may be from about 1/16 (0.0625) inch wide to about 3/16 (0.1875) inch wide. In another embodiment, however, the grooves 188 may have a different depth and/or a different width. The depth of the grooves 188 may be limited by the separation between the outside diameter of the rotor 174 and the channels 189. In an embodiment, the grooves 188 may have a cross-sectional shape that is rectangular, square, half-round, semi-circular, oblong, V-shaped, or other shape. The grooves 188 may have any rate of twist or pitch. The grooves 188 may have a 1 turn in 4 inches rate of twist, a 1 turn in 8 inches rate of twist, a 1 turn in 12 inches rate of twist, a 1 turn in 16 inches rate of twist, a 1 turn in 20 inches rate of twist, a 1 turn in 24 inches rate of twist, a 1 turn in 28 inches rate of twist, a 1 turn in 32 inches rate of twist, a 1 turn in 36 inches rate of twist, a 1 turn in 40 inches rate of twist, a 1 turn in 44 inches rate of twist, a 1 turn in 48 inches rate of twist, or some other rate of twist. In an embodiment, the grooves 188 may have a rate of twist between a 1 turn in 4 inches rate of twist and a 1 turn in 24 inches rate of twist. In an embodiment, the grooves 188 may have a rate of twist between a 1 turn in 4 inches rate of twist and a 1 turn in 48 inches rate of twist. In an embodiment, the grooves are not twisted and extend axially along the outside surface 187 of the rotor 174 and parallel to the longitudinal axis 179 of the rotor 174.

While the grooves 188 are illustrated in FIG. 4A as turning in a first sense, in another embodiment, the grooves 188 may turn in an opposite sense. In an embodiment of the electric motor 122 where there are both grooves 184 on the inside surface 185 of the stator 176 and grooves 188 on the outside surface 187 of the rotor 174, the grooves 188 may turn in the same sense as the grooves 184 turn, or the grooves 188 may turn in the opposite sense of the grooves 184 turn. In an embodiment, the grooves 188 in the outside surface 187 of the rotor 174 may act in part as fluid movers to urge the oil within the electric motor 122 to flow, for example like an auger might urge flow of fluids or particles.

Figure 4B:
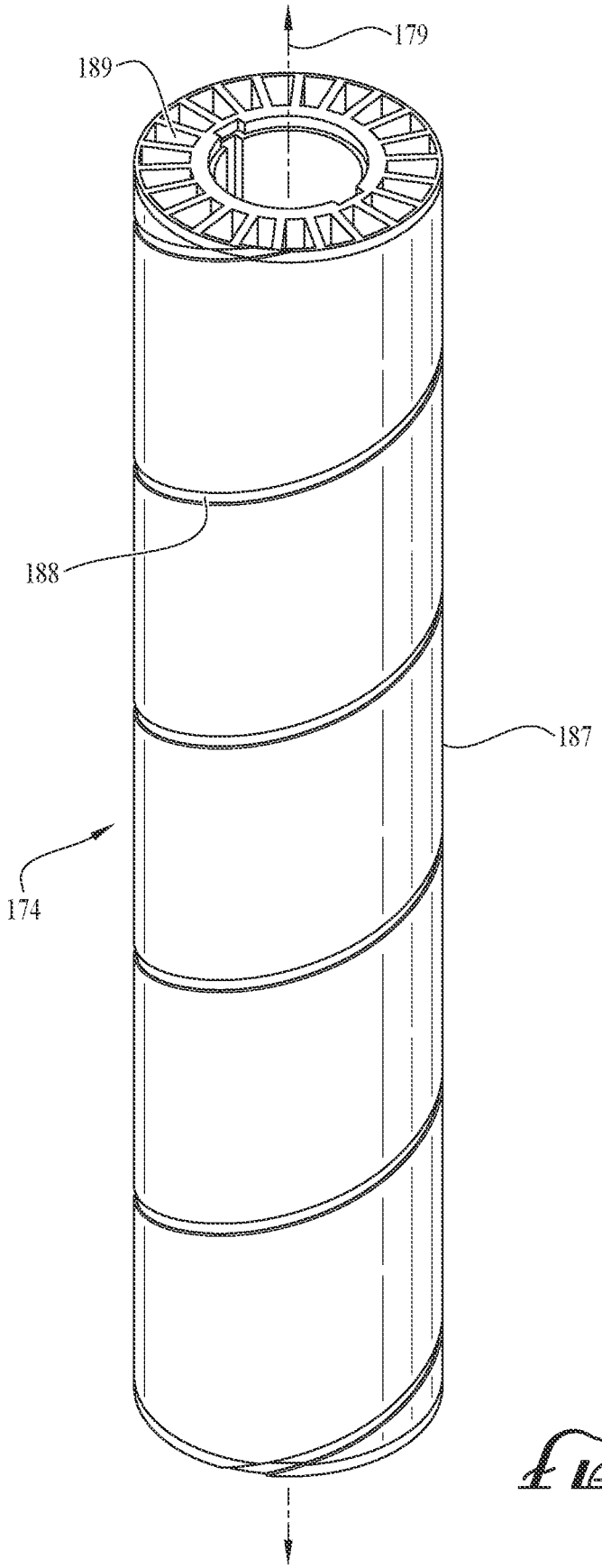
FIG. 4B is an illustration of another rotor of an electric motor according to an embodiment of the disclosure.

Turning now to FIG. 4B, another embodiment of the rotor 174 is described. In FIG. 48, only a single groove 188 is defined by the outside surface 187 of the rotor 174. The descriptions of the rotor 174 above with reference to FIG. 4A apply to FIG. 4B, with the restriction that there is the single groove 188, and that the rate of twist of the groove 188 may have a higher rate of twist, for example a 1 turn in inches rate of twist to a 1 turn in 12 inches rate of twist.

Figure 5A:
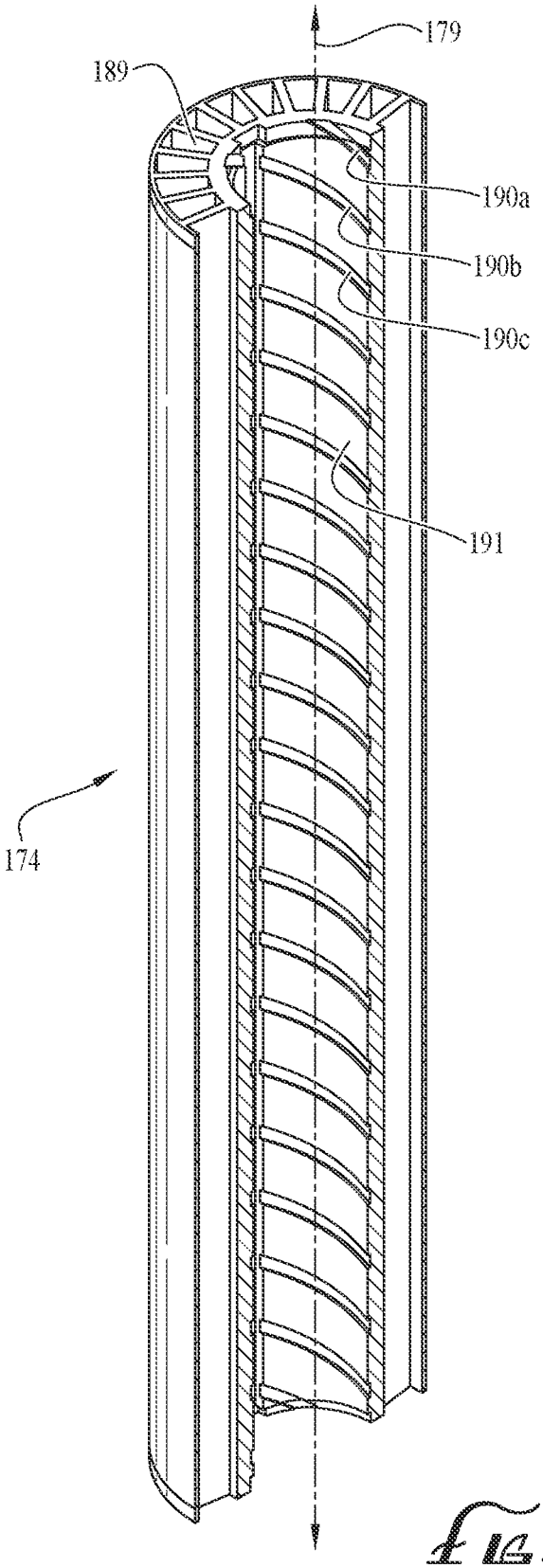
FIG. 5A is an illustration of another rotor of an electric motor according to an embodiment of the disclosure.

Turning now to FIG. 5A, further details of the rotor 174 are described. In an embodiment, the rotor 174 defines a plurality of helical grooves in an inside surface 191 of the rotor 174, for example a ninth groove 190*a*, a tenth groove 190*b*, and an eleventh groove 190*c*. In an embodiment, the rotor 174 may define one or more grooves 188 on the outside surface 187 of the rotor 174 (as described above with reference to FIG. 4A and FIG. 4B above) and also define the grooves 190 in the inside surface 191 of the rotor 174. Alternatively, in an embodiment, the outside surface 187 of the rotor 174 does not define any grooves and grooves 190 are defined in the inside surface 191 of the rotor 174. To simplify the illustration in FIG. 5A to better show the grooves 190, only one lamination is shown at an upper end of the rotor 174 and only one lamination is shown at the lower end of the rotor 174, but it is understood that the rotor 174 is composed of many laminations as illustrated in FIG. 2. The grooves 190 provide channels to improve the flow of oil within the electric motor 122, whereby to enhance the transfer of heat out of the electric motor 122. While three grooves 190*a*, 190*b*, 190*c* are illustrated in FIG. 5A, it is understood that the inside surface 191 of the rotor 174 may define two grooves or more than three grooves. The case of the inside surface 191 of the rotor 174 defining a single groove 190 is illustrated and described with reference to FIG. 5B below.

The grooves 190 may be cut in the rotor 174 after laminations are assembled to form the rotor 174. Alternatively, the individual laminations may be cut with a groove slightly offset, and the helical groove established by aligning the individual laminations when assembling the rotor 174. Alternatively, the individual laminations may be 3-0 printed with a grove slightly offset, and the helical groove established by aligning the individual laminations when assembling the rotor 174. The grooves 190 may be cut in the rotor 174 by machining the grooves 190 or by laser cutting the grooves 190 or by another method.

In an embodiment, the grooves 190 may be from 1/10000 (0.0001) inch deep to 1/100 (0.01) inch deep. In an embodiment, the grooves 190 are about 2/10000 (0.0002) inch deep. In an embodiment, the grooves 190 are about 5/1000 (0.005) inch deep. In an embodiment, the grooves 190 may be from about 1/10000 (0.0001) inch deep to about 2/100 (0.02) inch deep. In an embodiment, the grooves 190 are between 0.01 inch deep and 0.03 inch deep. In an embodiment, the grooves 190 may be from about 1/10 (0.1) inch wide to about 1/2 (0.5) inch wide. In an embodiment, the grooves 190 may be from about 1/16 (0.0625) inch wide to about 3/16 (0.1875) inch wide. In an embodiment, the grooves 190 may be between 1/16 (0.0625) inch wide and % (0.25) inch wide. In another embodiment, however, the grooves 190 may have a different depth and/or a different width. In an embodiment, the grooves 190 may have a cross-sectional shape that is rectangular, square, half-round, semi-circular, oblong, V-shaped, or other shape. The grooves 190 may have any rate of twist or pitch. The grooves 190 may have a 1 turn in 4 inches rate of twist, a 1 turn in 8 inches rate of twist, a 1 turn in 12 inches rate of twist, a 1 turn in 16 inches rate of twist, a 1 turn in 20 inches rate of twist, a 1 turn in 24 inches rate of twist, or some other rate of twist. In an embodiment, the grooves 190 may have a rate of twist between a 1 turn in 4 inches rate of twist and a 1 turn in 24 inches rate of twist. In an embodiment, the grooves are not twisted and extend axially along the inside surface 191 of the rotor 174 and parallel to the longitudinal axis 179 of the rotor 174. While the grooves 190 are illustrated in FIG. 5A as turning in a first sense, in another embodiment, the grooves 190 may turn in an opposite sense. In an embodiment, the grooves 190 in the inside surface 191 of the rotor 174 may act in part as fluid movers to urge the oil within the electric motor 122 to flow, for example like an auger might urge flow of fluids or particles. Because the keyway and key that couple the rotor 174*a*, 174*b*, 174*c* to the drive shaft 170 may otherwise interrupt the oil flow pathway in the grooves 190*a*, 190*b*, 190*c* (e.g., when the grooves 190 have a helical configuration rather than a longitudinally parallel configuration), the key may be modified to have notches at positions where the grooves meet the key. Using grooves 190*a*, 190*b*, 190*c* on the inside surface 191 of the rotors 174*a*, 174*b*, 174*c* that are parallel to the longitudinal axis 179 of the rotors 174 may provide the advantage of omitting the notching of the key.

Figure 5B:
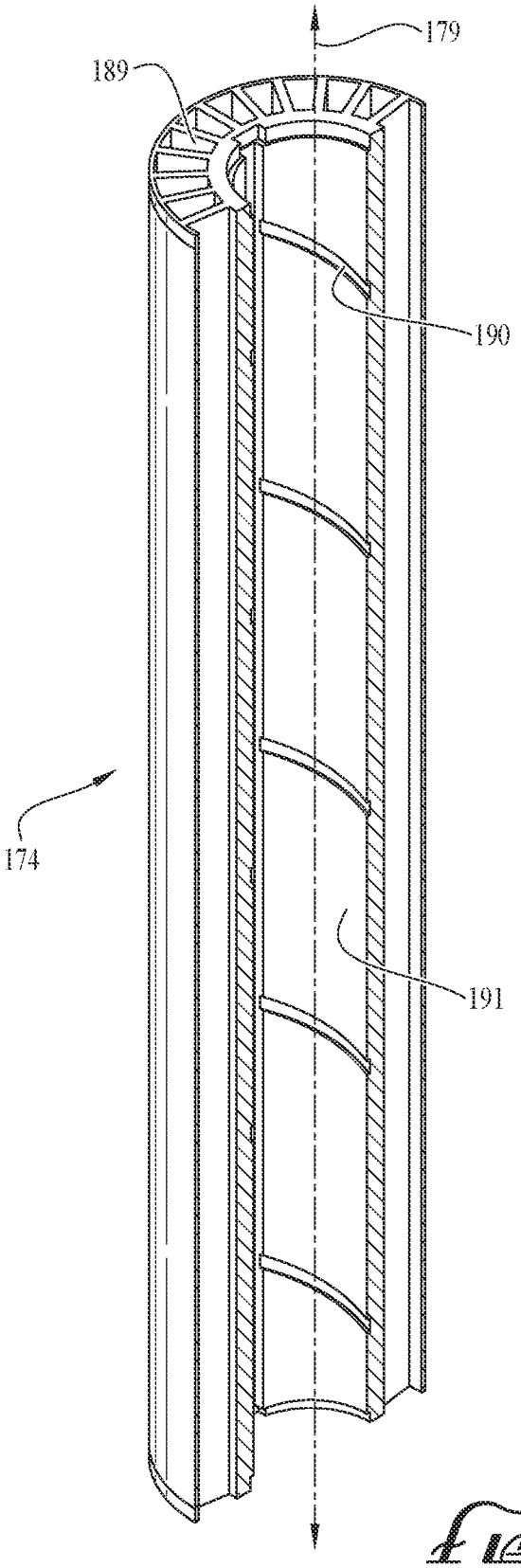
FIG. 5B is an illustration of yet another rotor of an electric motor according to an embodiment of the disclosure.

Turning now to FIG. 5B, another embodiment of the rotor 174 is described. In FIG. 5B, only a single groove 190 is defined by the inside surface 191 of the rotor 174. The descriptions of the rotor 174 above with reference to FIG. 5A apply to FIG. 5B, with the restriction that there is the single groove 190, and that the rate of twist of the groove 190 may have a higher rate of twist, for example a 1 turn in inches rate of twist to a 1 turn in 12 inches rate of twist.

Figure 6:
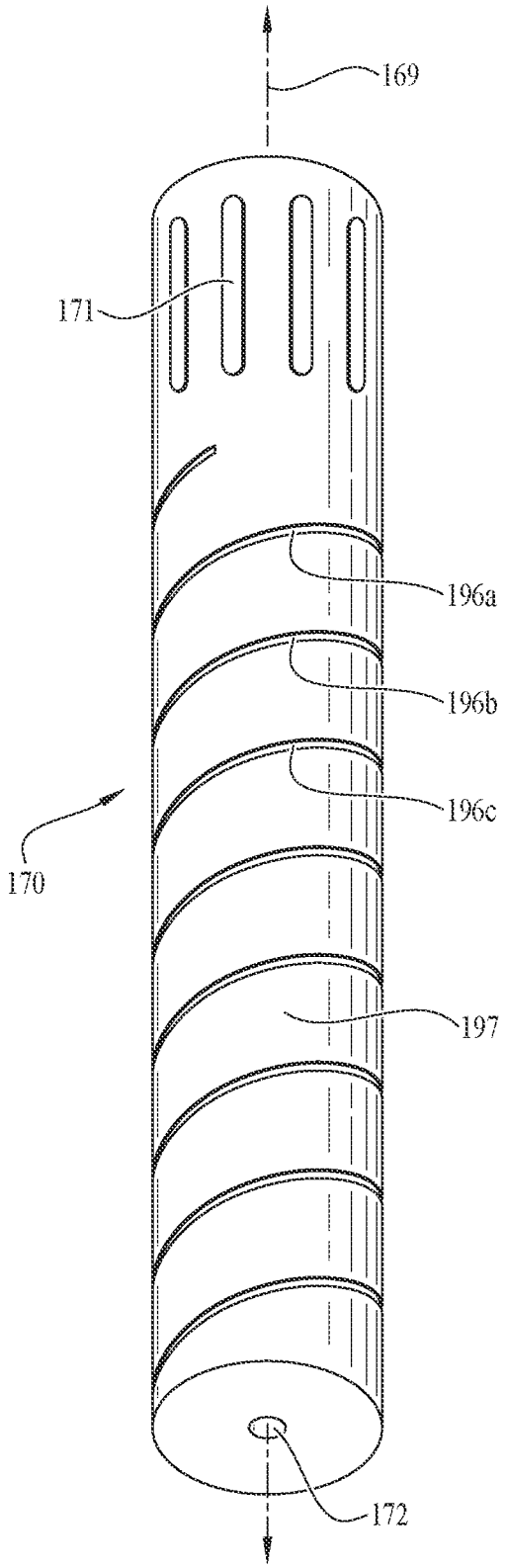
FIG. 6 is an illustration of a drive shaft of an electric motor according to an embodiment of the disclosure.

Turning now to FIG. 6, further details of the drive shaft 170 are described. In an embodiment, an outside surface 197 of the drive shaft 170 defines a plurality of helical grooves 196: a twelfth groove 196*a*, a thirteenth groove 196*b*, and a fourteenth groove 196*c*. The grooves 196 may be cut in the outside surface 197 of the drive shaft 170 during manufacturing and/or machining of the drive shaft 170. The grooves 196 provide channels to improve the flow of oil within the electric motor 122, whereby to enhance the transfer of heat out of the electric motor 122. While FIG. 6 illustrates a drive shaft 170 having an outside surface 197 defining three grooves 196*a*, 196*b*, 196*c*, it is understood that the drive shaft 170 may define two grooves or more than three grooves. The grooves 196*a*, 196*b*, 196*c* may extend from a point less than 3 feet below, less than 2 feet below, less than 1 foot below, less than 9 inches below, or less than 6 inches below the male splines 171 to a lower end of the drive shaft 170. In an embodiment, the grooves 196 may be cut in the drive shaft 170 by machining the grooves 196 or by laser cutting the grooves 196 or by another method.

In an embodiment, the grooves 196 may be from 1/10000 (0.0001) inch deep to 1/100 (0.01) inch deep. In an embodiment, the grooves 196 are about 2/10000 (0.0002) inch deep. In an embodiment, the grooves 196 are about 5/1000 (0.005) inch deep. In an embodiment, the grooves 196 are between 0.01 inch deep and 0.03 inch deep. In an embodiment, the grooves 196 may be from about 1/10 (0.1) inch wide to about 1/2 (0.5) inch wide. In an embodiment, the grooves 196 may be from about 1/16 (0.0625) inch wide to about 3/16 (0.1875) inch wide. In an embodiment, the grooves 196 may be between 1/16 (0.0625) inch wide and % (0.25) inch wide. In another embodiment, however, the grooves 196 may have a different depth and/or a different width. In an embodiment, the grooves 196 may have a cross-sectional shape that is rectangular, square, half-round, semi-circular, oblong, V-shaped, or other shape. The grooves 196 may have any rate of twist or pitch. The grooves 196 may have a 1 turn in 4 inches rate of twist, a 1 turn in 8 inches rate of twist, a 1 turn in 12 inches rate of twist, a 1 turn in 16 inches rate of twist, a 1 turn in 20 inches rate of twist, a 1 turn in 24 inches rate of twist, a 1 turn in 28 inches rate of twist, a 1 turn in 32 inches rate of twist, a 1 turn in 36 inches rate of twist, a 1 turn in 40 inches rate of twist, a 1 turn in 44 inches rate of twist, a 1 turn in 48 inches rate of twist, or some other rate of twist. In an embodiment, the grooves 196 may have a rate of twist between a 1 turn in 4 inches rate of twist and a 1 turn in 24 inches rate of twist. In an embodiment, the grooves 196 have a rate of twist between 1 turn in 4 inches rate of twist and 1 turn in 48 inches rate of twist. In an embodiment, the grooves are not twisted and extend axially along the outside surface 197 of the drive shaft 170 and parallel to the longitudinal axis 169 of the drive shaft 170. While the grooves 196 are illustrated in FIG. 6 as turning in a first sense, in another embodiment, the grooves 196 may turn in an opposite sense. In an embodiment, the grooves 196 in the outside surface 197 of the drive shaft 170 may act in part as fluid movers to urge the oil within the electric motor 122 to flow, for example like an auger might urge flow of fluids or particles.

Figure 7:
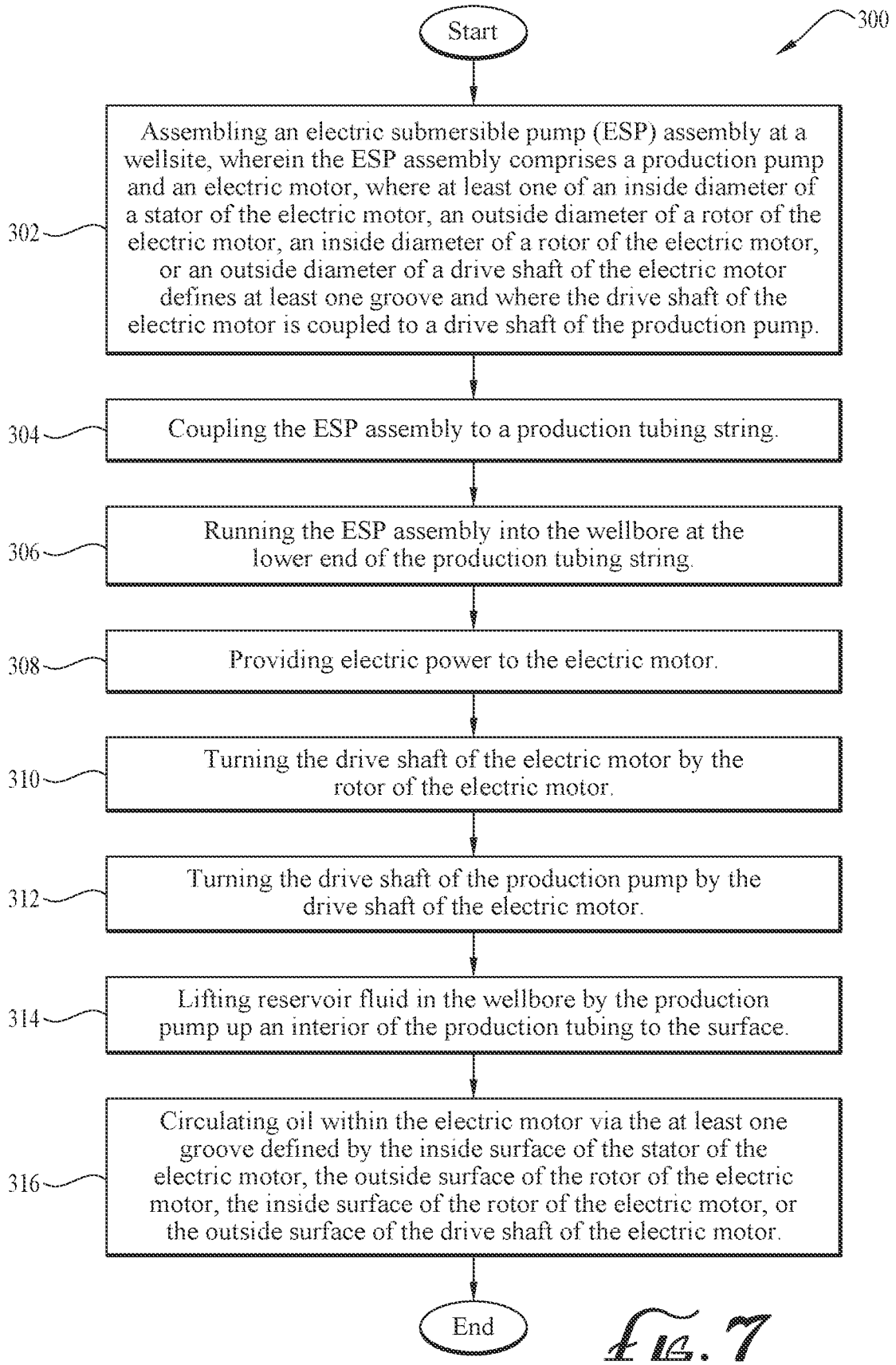
FIG. 7 is a flowchart of a method of lifting reservoir fluid in a wellbore to a surface location according to an embodiment of the disclosure.

Turning now to FIG. 7, a method 300 is described. In an embodiment, the method 300 is a method of lifting reservoir fluid in a wellbore to a surface location. At block 302, the method 300 comprises assembling an electric submersible pump (ESP) assembly at a wellsite, wherein the ESP assembly comprises a production pump and an electric motor, where at least one of an inside surface of a stator of the electric motor, an outside surface of a rotor of the electric motor, an inside surface of a rotor of the electric motor, or an outside surface of a drive shaft of the electric motor defines at least one groove and where the drive shaft of the electric motor is coupled to a drive shaft of the production pump. In an embodiment, the ESP assembly further comprises a seal section between the electric motor and the production pump, wherein the seal section comprises a seal section drive shaft, the drive shaft of the electric motor is coupled to the drive shaft of the seal section, and the drive shaft of the seal section is coupled to the drive shaft of the production pump. In an embodiment, the ESP assembly further comprises a gas separator assembly between the electric motor and the production pump. In an embodiment, the ESP assembly further comprises a charge pump assembly between the electric motor and the gas separator assembly.

At block 304, the method 300 comprises coupling the ESP assembly to a production tubing string. At block 306, the method 300 comprises running the ESP assembly into the wellbore at the lower end of the production tubing string. At block 308, the method 300 comprises providing electric power to the electric motor.

At block 310, the method 300 comprises turning the drive shaft of the electric motor by the rotor of the electric motor. At block 312, the method 300 comprises turning the drive shaft of the production pump by the drive shaft of the electric motor. At block 314, the method 300 comprises lifting reservoir fluid in the wellbore by the production pump up an interior of the production tubing to the surface.

At block 316, the method 300 comprises circulating oil within the electric motor via the at least one groove defined by the inside surface of the stator of the electric motor, the outside surface of the rotor of the electric motor, the inside surface of the rotor of the electric motor, or the outside surface of the drive shaft of the electric motor. In an embodiment, circulating the oil within the electric motor comprises circulating the oil via a bore in the drive shaft of the electric motor that is concentric with a longitudinal axis of the drive shaft of the electric motor. In an embodiment, the electric motor comprises a bushing retained by the stator of the electric motor and a bearing coupled to the drive shaft of the electric motor and located within the bushing, and circulating the oil within the electric motor comprises circulating the oil via a plurality of passageways defined by the bushing.

ADDITIONAL EMBODIMENTS

The following are non-limiting, specific embodiments in accordance with the present disclosure.

A first embodiment which is an electric submersible pump (ESP) electric motor, comprising a motor housing; a stator retained within the motor housing; a drive shaft; and an at least one rotor mechanically coupled to the drive shaft and located concentric with and inside of the stator, wherein an inside surface of the stator defines a groove extending from an upper end to a lower end of the stator or an outside surface of the at least one rotor defines a groove extending from an upper end to a lower end of the at least one rotor.

A second embodiment which is the ESP electric motor of the first embodiment, wherein the groove extends helically from the upper end to the lower end of the inside surface of the stator or of the outside surface of the at least one rotor.

A third embodiment which is the ESP electric motor of the first or the second embodiment, wherein the inside surface of the stator defines a plurality of grooves extending from the upper end to the lower end of the stator.

A fourth embodiment which is the ESP electric motor of any of the first through third embodiment, wherein the outside surface of the at least one rotor defines a plurality of grooves extending from the upper end to the lower end of the at least one rotor.

A fifth embodiment, which is the ESP electric motor of any of the first through fourth embodiment, wherein an inside surface of the at least one rotor defines a groove extending from the upper end to the lower end of the at least one rotor.

A sixth embodiment, which is the ESP electric motor of any of the first through the fourth embodiment, wherein an inside surface of the at least one rotor defines a plurality of grooves extending from the upper end to the lower end of the at least one rotor.

A seventh embodiment, which is the ESP electric motor of any of the first through the sixth embodiment, wherein an upper end of the drive shaft defines male splines and an outside surface of the drive shaft defines a plurality of grooves extending from a point less than 1 foot below the male splines to a lower end of the drive shaft.

An eighth embodiment which is an electric submersible pump (ESP) electric motor, comprising: a motor housing; a stator retained within the motor housing; a drive shaft; and an at least one rotor mechanically coupled to the drive shaft and located concentric with and inside of the stator, wherein an inside surface of the at least one rotor defines a groove extending from an upper end to a lower end of the at least one rotor or an outside surface of the drive shaft defines a groove from an upper portion of the drive shaft adjacent an upper end of the at least one rotor to a lower portion of the drive shaft adjacent a lower end of the at least one rotor.

A ninth embodiment, which is the ESP electric motor of the eighth embodiment, wherein the groove is substantially parallel to a longitudinal axis of the at least one rotor or substantially parallel to a longitudinal axis of the drive shaft.

A tenth embodiment, which is the ESP electric motor of the eighth or the ninth embodiment, wherein the inside surface of the at least one rotor defines a plurality of grooves.

An eleventh embodiment, which is the ESP electric motor of any of the eighth to the tenth embodiment, wherein the outside surface of the drive shaft defines a plurality of grooves.

A twelfth embodiment, which is the ESP electric motor of any of the eighth to the eleventh embodiment, wherein the groove is between about 0.01 inch deep and about 0.03 inch deep.

A thirteenth embodiment, which is the ESP electric motor of any of the eighth to the twelfth embodiment, wherein the drive shaft defines a bore that is concentric with the longitudinal axis of the drive shaft.

A fourteenth embodiment, which is the ESP electric motor of any of the eighth to the thirteenth embodiment, wherein the groove is between about 1/16 inch wide and about % inch wide.

A fifteenth embodiment, which is a method of lifting reservoir fluid in a wellbore to a surface location, comprising assembling an electric submersible pump (ESP) assembly at a wellsite, wherein the ESP assembly comprises a production pump and an electric motor, where at least one of an inside surface of a stator of the electric motor, an outside surface of a rotor of the electric motor, an inside surface of a rotor of the electric motor, or an outside surface of a drive shaft of the electric motor defines at least one groove and where the drive shaft of the electric motor is coupled to a drive shaft of the production pump; coupling the ESP assembly to a production tubing string; running the ESP assembly into the wellbore at the lower end of the production tubing string; providing electric power to the electric motor; turning the drive shaft of the electric motor by the rotor of the electric motor; turning the drive shaft of the production pump by the drive shaft of the electric motor; lifting reservoir fluid in the wellbore by the production pump up an interior of the production tubing to the surface; and circulating oil within the electric motor via the at least one groove defined by the inside surface of the stator of the electric motor, the outside surface of the rotor of the electric motor, the inside surface of the rotor of the electric motor, or the outside surface of the drive shaft of the electric motor.

A sixteenth embodiment, which is the method of the fifteenth embodiment, wherein the ESP assembly further comprises a gas separator assembly between the electric motor and the production pump.

A seventeenth embodiment, which is the method of the the sixteenth embodiment, wherein the ESP assembly further comprises a charge pump assembly between the electric motor and the gas separator assembly.

An eighteenth embodiment, which is the method of any of the fifteenth through seventeenth embodiment, wherein circulating the oil within the electric motor comprises circulating the oil via a bore in the drive shaft of the electric motor that is concentric with a longitudinal axis of the drive shaft of the electric motor.

A nineteenth embodiment, which is the method of any of the fifteenth through eighteenth embodiment, wherein the electric motor comprises a bushing retained by the stator of the electric motor and a bearing coupled to the drive shaft of the electric motor and located within the bushing, and wherein circulating the oil within the electric motor comprises circulating the oil via a plurality of passageways defined by the bushing.

A twentieth embodiment, which is the method of any of the fifteenth through the nineteenth embodiment, wherein the ESP assembly further comprises a seal section between the electric motor and the production pump, wherein the seal section comprises a seal section drive shaft, the drive shaft of the electric motor is coupled to the drive shaft of the seal section, and the drive shaft of the seal section is coupled to the drive shaft of the production pump.

A twenty-first embodiment, which is an electric submersible pump (ESP) electric motor, comprising a motor housing; a stator retained within the motor housing; a drive shaft; and an at least one rotor mechanically coupled to the drive shaft and located concentric with and inside of the stator, wherein an inside surface of the stator defines a groove extending from an upper end to a lower end of the stator.

A twenty-second embodiment, which is an electric submersible pump (ESP) electric motor, comprising a motor housing; a stator retained within the motor housing; a drive shaft; and an at least one rotor mechanically coupled to the drive shaft and located concentric with and inside of the stator, wherein an outside surface of the at least one rotor defines a groove extending from an upper end to a lower end of the at least one rotor.

A twenty-third embodiment, which is an electric submersible pump (ESP) electric motor, comprising a motor housing; a stator retained within the motor housing; a drive shaft; and an at least one rotor mechanically coupled to the drive shaft and located concentric with and inside of the stator, wherein an inside surface of the at least one rotor defines a groove extending from an upper end to a lower end of the at least one rotor.

A twenty-fourth embodiment, which is an electric submersible pump (ESP) electric motor, comprising a motor housing; a stator retained within the motor housing; a drive shaft; and an at least one rotor mechanically coupled to the drive shaft and located concentric with and inside of the stator, wherein an outside surface of the drive shaft defines a groove extending from an upper end to a lower end of the at least one rotor.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. An electric submersible pump (ESP) electric motor, comprising:

a motor housing;

a stator retained within the motor housing;

a drive shaft defining a first keyway;

an at least one rotor located concentric with and inside of the stator, wherein an inside surface of the at least one rotor defines a second keyway, wherein (A) the inside surface of the at least one rotor defines a groove extending from an upper end to a lower end of the at least one rotor or (B) an outside surface of the drive shaft defines a groove that extends from an upper portion of the drive shaft adjacent an upper end of the at least one rotor to a lower portion of the drive shaft adjacent a lower end of the at least one rotor; and a key inserted in the first keyway and in the second keyway that mechanically couples the at least one rotor to the drive shaft, wherein an inside surface of the stator defines a groove extending from an upper end to a lower end of the stator or an outside surface of the at least one rotor defines a groove extending from an upper end to a lower end of the at least one rotor.

2. The ESP electric motor of claim 1, wherein the groove in the inside surface of the stator extends helically from the upper end to the lower end of the inside surface of the stator or the groove in the outside surface of the at least one rotor extends helically from the upper end to the lower end of the outside surface of the at least one rotor.

3. The ESP electric motor of claim 1, wherein the inside surface of the stator defines a plurality of grooves extending from the upper end to the lower end of the stator.

4. The ESP electric motor of claim 1, wherein the outside surface of the at least one rotor defines a plurality of grooves extending from the upper end to the lower end of the at least one rotor.

5. The ESP electric motor of claim 1, wherein an inside surface of the at least one rotor defines a plurality of grooves extending from the upper end to the lower end of the at least one rotor.

6. The ESP electric motor of claim 1, wherein an upper end of the drive shaft defines male splines and an outside surface of the drive shaft defines a plurality of grooves extending from a point less than 1 foot below the male splines to a lower end of the drive shaft.

7. The ESP electric motor of claim 1, wherein the inside surface of the at least one rotor defines a helical groove extending from the upper end to the lower end of the at least one rotor and wherein the key defines notches where the helical groove meets the key.

8. An electric submersible pump (ESP) electric motor, comprising:

a motor housing;

a stator retained within the motor housing;

a drive shaft defining a first keyway;

an at least one rotor located concentric with and inside of the stator, wherein an inside surface of the at least one rotor defines a second keyway, and wherein (A) the inside surface of the at least one rotor defines a groove extending from an upper end to a lower end of the at least one rotor or (B) an outside surface of the drive shaft defines a groove that extends from an upper portion of the drive shaft adjacent an upper end of the at least one rotor to a lower portion of the drive shaft adjacent a lower end of the at least one rotor; and a key inserted in the first keyway and in the second keyway that mechanically couples the at least one rotor to the drive shaft.

9. The ESP electric motor of claim 8, wherein the groove is substantially parallel to a longitudinal axis of the at least one rotor or substantially parallel to a longitudinal axis of the drive shaft.

10. The ESP electric motor of claim 8, wherein the inside surface of the at least one rotor defines a plurality of grooves.

11. The ESP electric motor of claim 8, wherein the outside surface of the drive shaft defines a plurality of grooves.

12. The ESP electric motor of claim 8, wherein the groove is between 0.01 inch deep and 0.03 inch deep.

13. The ESP electric motor of claim 8, wherein the groove is between 1/16 inch wide and 1/4 inch wide.

14. The ESP electric motor of claim 8, wherein the key defines notches where the groove meets the key.

15. A method of lifting reservoir fluid in a wellbore to a surface location, comprising:

assembling an electric submersible pump (ESP) assembly at a wellsite, wherein the ESP assembly comprises a production pump and an electric motor, where at least one of an inside surface of a rotor of the electric motor or an outside surface of a drive shaft of the electric motor defines at least one groove, where the inside surface of the rotor defines a first keyway, where the outside surface of the drive shaft defines a second keyway, where a key inserted in the first keyway and the second keyway mechanically couples the rotor to the drive shaft, and where the drive shaft of the electric motor is coupled to a drive shaft of the production pump;

coupling the ESP assembly to a production tubing string;

running the ESP assembly into the wellbore at the lower end of the production tubing string;

providing electric power to the electric motor;

turning the drive shaft of the electric motor by the rotor of the electric motor;

turning the drive shaft of the production pump by the drive shaft of the electric motor;

lifting reservoir fluid in the wellbore by the production pump up an interior of the production tubing to the surface; and circulating oil within the electric motor via the at least one groove defined by the inside surface of the rotor of the electric motor or the outside surface of the drive shaft of the electric motor.

16. The method of claim 15, wherein the ESP assembly further comprises a gas separator assembly between the electric motor and the production pump.

17. The method of claim 16, wherein the ESP assembly further comprises a charge pump assembly between the electric motor and the gas separator assembly.

18. The method of claim 15, wherein circulating the oil within the electric motor comprises circulating the oil via a bore in the drive shaft of the electric motor that is concentric with a longitudinal axis of the drive shaft of the electric motor.

19. The method of claim 18, wherein the electric motor comprises a bushing retained by the stator of the electric motor and a bearing coupled to the drive shaft of the electric motor and located within the bushing, and wherein circulating the oil within the electric motor comprises circulating the oil via a plurality of passageways defined by the bushing.

20. The method of claim 15, wherein the ESP assembly further comprises a seal section between the electric motor and the production pump, wherein the seal section comprises a seal section drive shaft, the drive shaft of the electric motor is coupled to the drive shaft of the seal section, and the drive shaft of the seal section is coupled to the drive shaft of the production pump.

* * * * *